US007484452B2

(12) United States Patent
Baxter et al.

(10) Patent No.: US 7,484,452 B2
(45) Date of Patent: Feb. 3, 2009

(54) FLUID END FOR A PLUNGER PUMP

(75) Inventors: Winston Kirk Baxter, Alice, TX (US); Michael Stuart Richards, Corpus Christi, TX (US)

(73) Assignee: Dixie Iron Works, Ltd., Alice, TX (US)

( * ) Notice: Subject to any disclaimer, the term of this patent is extended or adjusted under 35 U.S.C. 154(b) by 723 days.

(21) Appl. No.: 11/142,852

(22) Filed: Jun. 1, 2005

(65) Prior Publication Data

US 2006/0002806 A1 Jan. 5, 2006

Related U.S. Application Data

(60) Provisional application No. 60/584,889, filed on Jul. 1, 2004.

(51) Int. Cl.
*F04B 53/10* (2006.01)
*F04B 35/00* (2006.01)

(52) U.S. Cl. ..... 92/169.1; 417/539; 417/567

(58) Field of Classification Search ..... 92/169.1, 92/169.2; 417/521, 529, 539, 566, 567, 571, 417/572

See application file for complete search history.

(56) References Cited

U.S. PATENT DOCUMENTS 4,878,815 A * 11/1989 Stachowiak ..... 417/539
5,059,101 A * 10/1991 Valavaara ..... 417/539
5,061,159 A 10/1991 Pryor
5,073,096 A 12/1991 King et al.
5,253,987 A * 10/1993 Harrison ..... 417/571
5,636,975 A * 6/1997 Tiffany et al. ..... 417/539
7,335,002 B2 * 2/2008 Vicars ..... 417/568
7,341,435 B2 * 3/2008 Vicars ..... 417/568

OTHER PUBLICATIONS

Badr EA, Sorem JR, Tipton SM; Evaluation of the Autofreitage Effect on Fatique Lives of Steel Blocks with Crossbores Using a Statistical and a Strain-Based Method, Journal of Testing and Evaluation, May 2000, pp. 181-187, vol. 28, Issue 3.

* cited by examiner

*Primary Examiner*—Thomas E Lazo
(74) *Attorney, Agent, or Firm*—Henry L. Ehrlich; Winstead PC

(57) ABSTRACT

A fluid end for a reciprocating pump including a body having a base, a side and a longitudinal opposing side, a cylinder bore formed horizontally through the body and a vertical bore intersecting the cylinder bore defining a high stress region proximate the intersection, and a tension member extending through the body substantially parallel to the longitudinal axis of the body, wherein the tension member provides a compressive load on the body reducing the stresses encountered in the region during operation of the fluid end.

24 Claims, 5 Drawing Sheets

FLUID END FOR A PLUNGER PUMP

RELATED APPLICATIONS

This application is related to and claims priority to U.S. Provisional Application, Ser. No. 60/584,889, filed on Jul. 1, 2004.

FIELD OF THE INVENTION

The present invention relates in general to pumps and more specifically to the fluid end of plunger pumps.

BACKGROUND

High-pressure, reciprocating, plunger pumps have been used for many years and are a mainstay in the well services industry. These well service pumps often produce pressurized fluid in excess of 15,000 pounds per square inch. High stresses on the fluid ends of these pumps are associated with these high pressures.

Due to space limitation at transport equipment and well sites reduced profile pumps and equipment are desired. Therefore, a popular fluid end has an intersecting horizontal cylinder bore and vertical bore. While these configurations may provide a reduced profile they also produce a high stress region proximate the intersection of the bores that suffers fatigue failure do to the high stresses encountered. These failures result in expensive repairs or replacement. Prior heretofore expensive techniques have been utilized to reduce these stress related failures with unsatisfactory success.

SUMMARY OF THE INVENTION

In view of the foregoing and other considerations, the present invention relates to reciprocating pumps. In particular it is a desire of the present invention to reduce the stresses encountered in fluid ends having a intersecting bores. It is a further desire to provide an apparatus and system that reduces the frequency and cost of repairing or replacing fluid ends. It is an additional desire to provide an apparatus and method that provides an economical and effective means for reducing fatigue failures in the fluid ends of reciprocating pumps.

Accordingly, an embodiment of a fluid end for a reciprocating pump is provided, the fluid end including a body having a base, a side and a longitudinal opposing side, a cylinder bore formed horizontally through the body and a vertical bore intersecting the cylinder bore defining a high stress region proximate the intersection, and a tension member extending through the body substantially parallel to the longitudinal axis of the body, wherein the tension member provides a compressive load on the body reducing the tensile stresses encountered in the region during operation of the fluid end.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
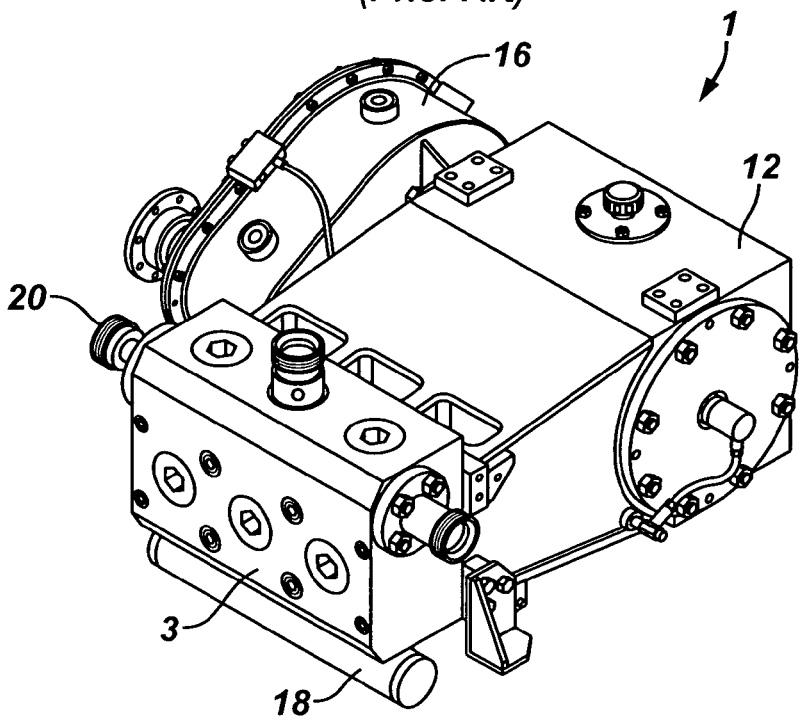
FIG. 1 (Prior Art)
FIG. 1 is a perspective view of a prior art reciprocating pump.

Refer now to the drawings wherein depicted elements are not necessarily shown to scale and wherein like or similar elements are designated by the same reference numeral through the several views.

FIG. 1 is a perspective view of a prior art reciprocating plunger pump of the present invention, generally denoted by the numeral 1. Pump 1 is a typical, high-pressure, reciprocating fluid pump. Pump one comprises three primary portions, a power end 12, fluid end 3 and gear works 16. The power end 12 is conventional and contains a crankshaft, connecting rods, and various machinery required to reciprocate a plunger within the bore and cylinder of fluid end 14. The fluid end includes a suction intake manifold 18 and discharge ports 20.

As will be described in more detail with reference to the Figures of the present invention, the prior art fluid end 3 is susceptible to fatigue stresses that result in failure of pump 1 requiring expensive repairs and more often replacement. Prior techniques have been utilized with limited success to limit these fatigue failures. Such techniques include "autofrettage," which has shown limited results. However, autofrettage is a laborious task and requires excessive pressure producing equipment. The minimum autofrettage pressure required to show any increase in fatigue life improvement is at least two times the pressure that results in yielding of the material. For example, an ideal autofrettage pressure is roughly 75,000 to 100,000 pounds per square inch.

Other prior art techniques have included "shot peening" compressive stresses at the crack location, and hand grinding radii at the intersection of the fluid end bores. None of these prior art techniques have satisfactorily addressed the internal material stresses and resulting fatigue failures.

Figure 2:
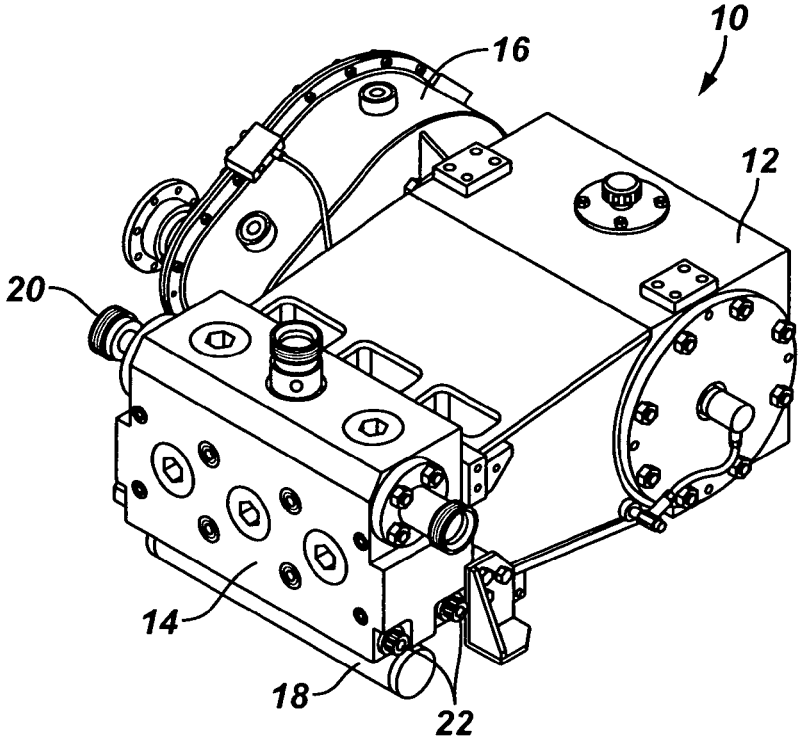
FIG. 2 is a perspective view of an embodiment of the reciprocating pump of the present invention.

FIG. 2 is a perspective view of a reciprocating plunger pump, generally denoted by the numeral 10, of the present invention. Pump 10 includes gear works 16, power end 12, and a internal material stress reducing fluid end 14. Fluid end 14 includes tension members 22 extending through body 24 substantially parallel to the longitudinal axis of body 24.

Figure 3:
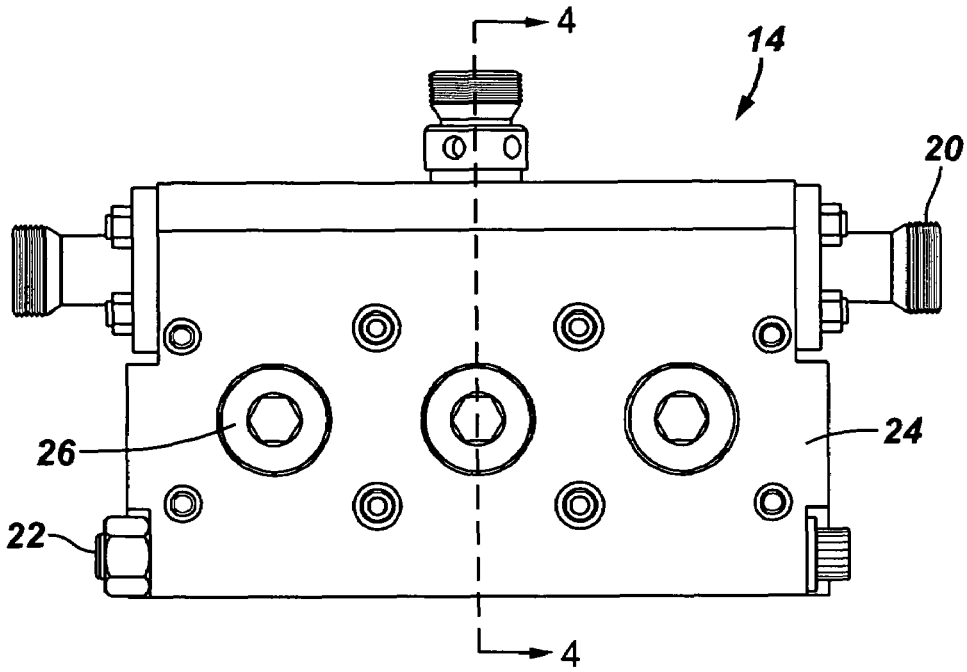
FIG. 3 is a front view of the fluid end of the present invention.

FIG. 3 is a front view of fluid end 14 of the present invention in isolation. Fluid end 14 includes a body 24. Cylinder heads 26 show that the illustrated fluid end 14 is for a triplex pump.

Figure 4:
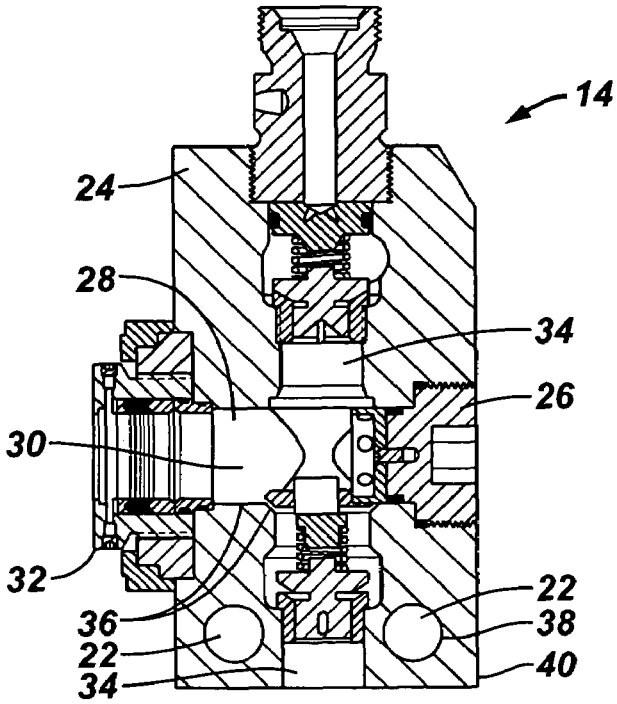
FIG. 4 is a cross-sectional view of the fluid end of the present invention shown along the line 4-4 of FIG. 3.

FIG. 4 is a cross-section view of fluid end 14 shown along the line 4-4 of FIG. 3. Body 24 forms a horizontal cylinder 28 having a bore 30. Cylinder 28 and bore 30 connect to power end 12 (FIG. 1) at connection 32. As is well known in the art cylinder 30 is adapted to carry the pump plunger.

Body 24 also forms a vertical bore 34 that intersects cylinder bore 30. This intersecting vertical and horizontal bore configuration is desired in the industry because of its compact profile. However, these intersecting bore configurations result in excessive failures by fatigue cracks that are produced at the high stress regions 36 proximate the intersection of horizontal bore 28 and vertical bore 34.

The present invention addresses these high stresses and the fatigue failure at regions 36 by providing tension members 22. Tension members 22 are elongated members of sufficient strength to provide the compressive loads necessary to compress, or squeeze, the high stressed regions 36. The present invention facilitates applying compressive stress at the high stressed regions 36 and the compressive stress thereby counters the tensile stresses in region 36. The reduction in the tensile, hoop, stresses lengthens the service life of body 24 by the corresponding reduction of the tensile (hoop) stresses. Use of tension members 22 negates the need for the autofrettage process.

Figure 5:
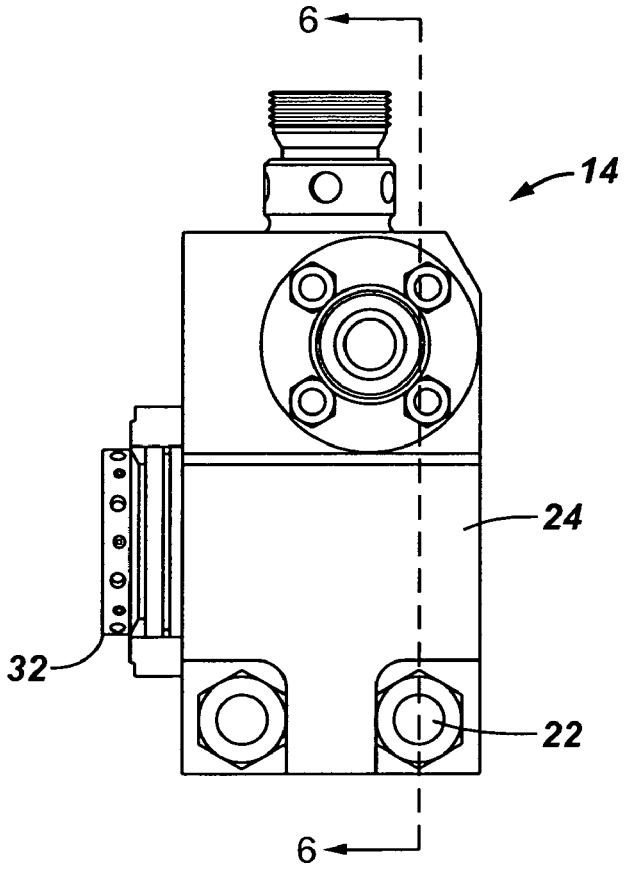
FIG. 5 is a side view of the fluid end of the present invention.
Figure 6:
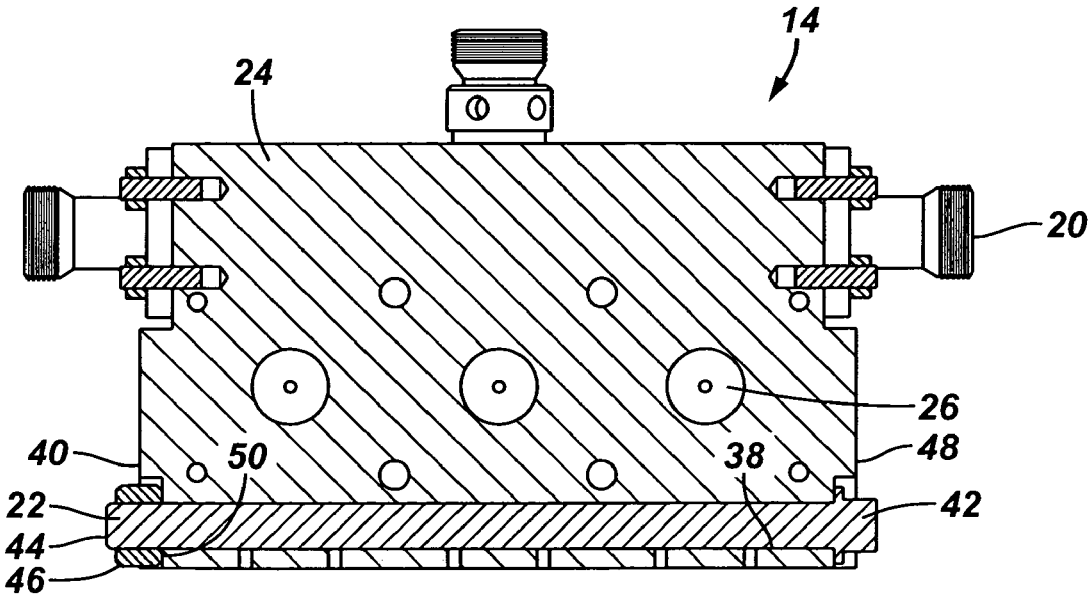
FIG. 6 is a cross-sectional view of the fluid end of the present invention shown along the line 6-6 of FIG. 5.

FIG. 6 is a cross-sectional view of fluid end 14 of the present invention shown along the line 6-6 of FIG. 5. As shown, longitudinal paths 38 are formed through body 24 substantially parallel to the longitudinal axis of body 24. Paths 38 may be formed by drilling. As shown in FIG. 4, a pair of longitudinal bores 38 may be formed proximate the base 40 of body 24 straddling vertical bore 34.

Longitudinal tension members 22 comprise a first end 42 and a second end 44. In an embodiment of the present invention first end 42 is a bolt head and second end 44 is threaded for mating with a nut 46. In another embodiment tension members 22 may be elongated members wherein first and second ends 42, 44 are both threaded and tension members 22 are compressively connected to body 24 via nuts 46. It should be recognized that tension member 22 and the mechanisms for connecting and providing a compressive load via tension members 22 may be utilized without departing from the scope and spirit of the present invention.

Figure 7:
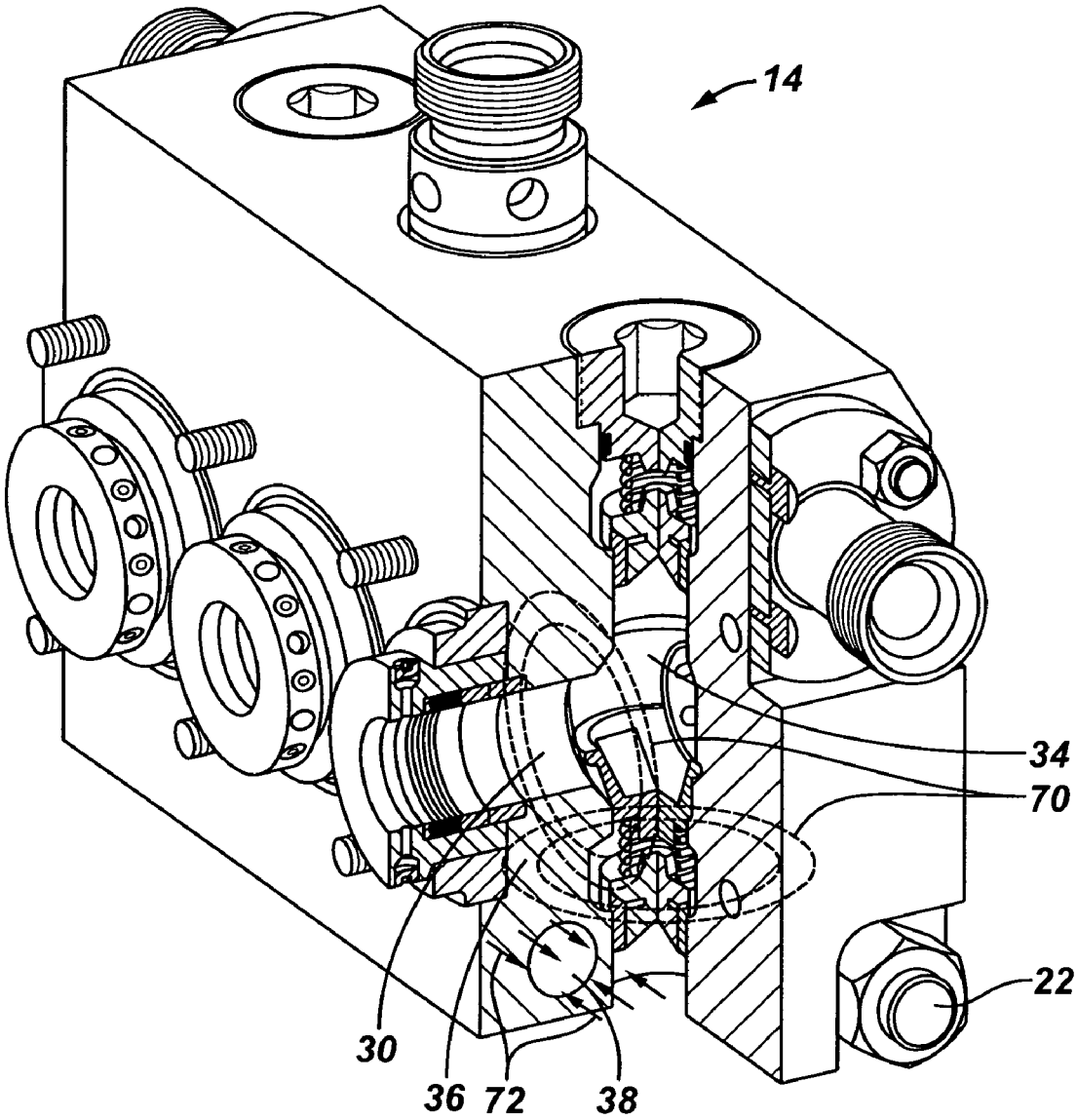
FIG. 7 is a partial cross-sectional view of the fluid end of the present invention illustrating the tensile (hoop) stresses encountered during operation and the reactive compressive loads provided.

FIG. 7 is a partial cross-sectional view of fluid end 14 of the present invention. The tensile (hoop) stresses encountered in the high stress region 36 are illustrated by the circular arrows denoted by the numeral 70. Stresses 70 are countered by the compressive load, illustrated by the arrows denoted by the numeral 72, provided by tension members 22. As can be seen tension member path 38 and tension members 22 are positioned proximate high stress region 36.

A method of the present invention is described with reference to FIGS. 2 through 7. Fluid head 14 is manufactured with paths 44 or retrofitted by forming paths 44 longitudinally through body 24. A desirable number of two paths 44 may be formed. Tension members 22 are disposed in paths 44 so that first end 42 abuts an end 48 of body 24, and the second end 44 extends beyond the opposing side 50 of body 24. Nut 46 is threaded on second end 44 and threaded against opposing side 50 until a desired compressive load 72 is achieved at regions 36. A desired compressive load 72 is used to counter the tensile (hoop) stresses 70 during operation of body 24. In operation, tension members 22 may be adjusted to maintain a desired compressive load and/or be replaced. Thus, the tension members 22 and method of the present invention reduce the stress at regions 36 prolonging the life of the fluid end 14.

Figure 8:
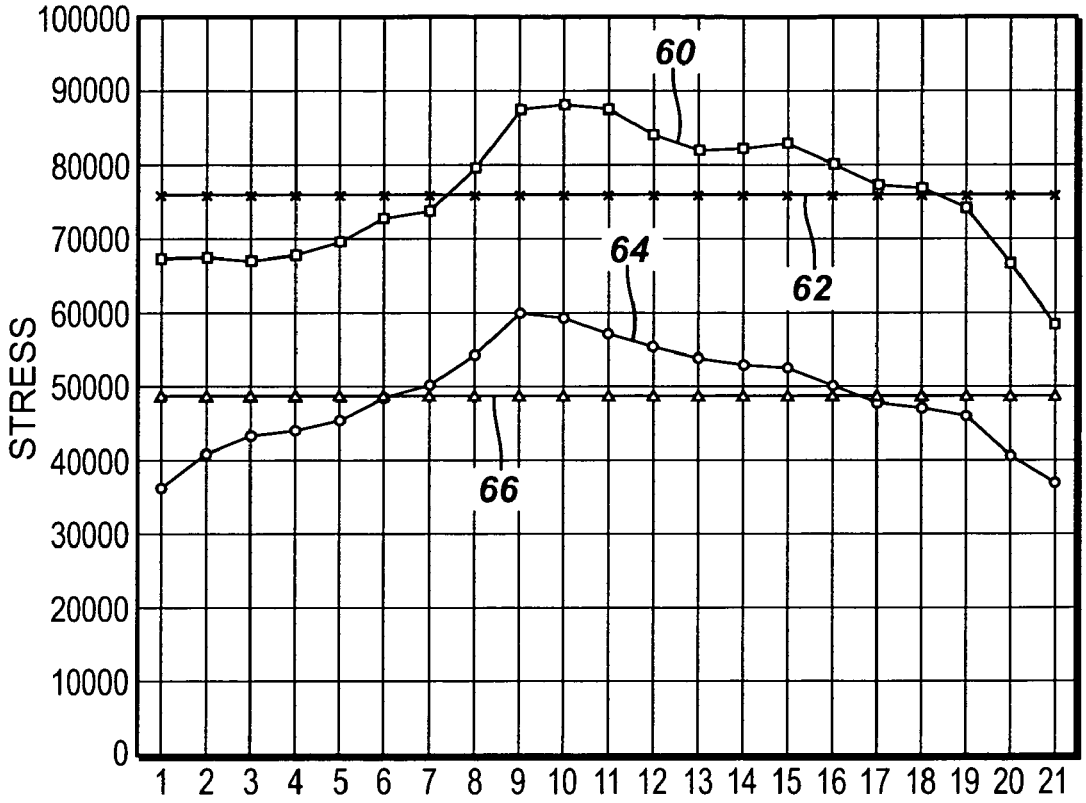
FIG. 8 is a graphical representation of an example of the stress reduction produced by the present invention.

FIG. 8 is a graphical representation of an example of the reduction in stress encountered in pounds per square inch at region 36 (FIG. 4) of the prior art fluid end 3 of FIG. 1 versus fluid end 14 of the present invention shown in FIGS. 2-6. Curve 60 shows the stress at region 36 in fluid end 3 during operation of pump 1. Curve 62 is the average stress encountered at region 36 of fluid end 3 during the operation of pump 1.

Curve 64 shows the stress at region 36 in fluid end 14 during the operation of pump 10 of the present invention. Curve 66 is the average stress encountered at region 36 of fluid end 14 during the operation of pump 10 of the present invention.

As can be seen, the tension members and method of the present invention significantly reduce the stress encountered by body 24 of fluid end 14. Thereby decreasing the occurrence of fatigue failure of the fluid end and reducing expensive repairs and replacement of fluid ends. The present invention additionally provides an effective and cost efficient means for addressing the disadvantages of the popular intersecting bore fluid end.

From the foregoing detailed description of specific embodiments of the invention, it should be apparent that an improved fluid end for reciprocating pumps that is novel and unobvious has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A fluid end for a reciprocating pump, the fluid end comprising:

a body having a base, a side and a longitudinal opposing side;

a cylinder bore formed horizontally through the body;

a vertical bore intersecting the cylinder bore;

a region proximate the intersection of the vertical bore and the cylinder bore; and a tension member extending through the body substantially perpendicular to the cylinder bore, wherein the tension member provides a compressive load on the body.

2. The fluid end of claim 1, wherein the tension member is positioned proximate the region of the body.

3. The fluid end of claim 1, wherein the compressive load counters a portion of the tensile stress encountered in the body.

4. The fluid end of claim 1, the compressive load is applied at the region.

5. The fluid end of claim 4, wherein the compressive load counters a portion of the tensile stress encountered in the body.

6. The fluid end of claim 1, wherein the tension member comprises:

an elongated member having a bolt head end and a threaded end; and a nut engaging the threaded end, wherein the bolt head engages the side of the body and the nut is tightened against the longitudinal opposing side to produce the compressive load.

7. The fluid end of claim 1, wherein the tension member comprises:

an elongated member; and connectors for compressively connecting the elongated member to the body.

8. The fluid end of claim 6, wherein the tension member is positioned proximate the region of the body.

9. The fluid end of claim 7, wherein the tension member is positioned proximate the region of the body.

10. A reciprocating pump comprising:

a power end; and a fluid end connected to the power end, the fluid end comprising:

a body having a base, a side and a longitudinal opposing side;

a cylinder bore formed horizontally through the body;

a vertical bore intersecting the cylinder bore;

a region proximate the intersection of the vertical bore and the cylinder bore; and a tension member extending through the body substantially perpendicular to the cylinder bore, wherein the tension member provides a compressive load on the body.

11. The pump of claim 10, wherein the tension member is positioned proximate the region of the body.

12. The pump of claim 10, wherein the compressive load counters a portion of the tensile stress encountered in the body.

13. The pump of claim 10, the compressive load is applied at the region.

14. The pump of claim 13, wherein the compressive load counters a portion of the tensile stress encountered in the body.

15. The pump of claim 10, wherein the tension member comprises:

an elongated member having a bolt head end and a threaded end; and a nut engaging the threaded end, wherein the bolt head engages the side of the body and the nut is tightened against the longitudinal opposing side to produce the compressive load.

16. The pump of claim 10, wherein the tension member comprises:

an elongated member; and connectors for compressively connecting the elongated member to the body.

17. The pump of claim 15, wherein the tension member is positioned proximate the region of the body.

18. The pump of claim 16, wherein the tension member is positioned proximate the region of the body.

19. A method of reducing fatigue failures in a fluid end of a reciprocating pump, the method comprising the steps of:

forming a pathway through a body of a fluid end of a reciprocating pump substantially perpendicular to a cylinder bore formed in the fluid end;

disposing a tension member in the pathway; and applying a compressive load to the body via the tension member to reduce the tensile stresses encountered in the body.

20. The method of claim 19, wherein the tension member comprises:

an elongated member having a bolt head end and a threaded end; and a nut engaging the threaded end, wherein the bolt head engages the side of the body and the nut is tightened against the longitudinal opposing side to produce the compressive load.

21. A fluid end for a reciprocating pump, the fluid end comprising:

a body having a base, a side and a longitudinal opposing side;

a cylinder bore formed horizontally though the body;

a vertical bore intersecting the cylinder bore;

a region proximate the intersection of the vertical bore and the cylinder bore; and a tension member extending though the body substantially parallel to the longitudinal axis of the body, the tension member comprising:

an elongated member having a bolt head end and a threaded end; and a nut engaging the threaded end, wherein the bolt head engages the side of the body and the nut is tighten against the longitudinal opposing side to produce the compressive load.

22. The fluid end of claim 21, wherein the tension member is positioned proximate the region of the body.

23. A reciprocating pump comprising:

a power end; and a fluid end connected to the power end, the fluid end comprising:

a body having a base, a side and a longitudinal opposing side;

a cylinder bore formed horizontally through the body;

a vertical bore intersecting the cylinder bore;

a region proximate the intersection of the vertical bore and the cylinder bore; and a tension member extending through the body substantially perpendicular to the cylinder bore, wherein the tension member provides a compressive load on the body, the tension member comprising:

an elongated member having a bolt head end and a threaded end; and a nut engaging the threaded end, wherein the bolt head engages the side of the body and the nut is tighten against the longitudinal opposing side to produce the compressive load.

24. The pump of claim 23, wherein the tension member is positioned proximate the region of the body.

* * * * *